United States Patent [19]

Wheeler

[11] 3,946,909

[45] Mar. 30, 1976

[54] BIN CLOSURE SUPPORTED CLOSING MECHANISM

[76] Inventor: Robert R. Wheeler, 7615 Shady Oak Drive, Downey, Calif. 90240

[22] Filed: Nov. 7, 1974

[21] Appl. No.: 521,554

[52] U.S. Cl. ..... 222/181; 222/556;181

[51] Int. Cl.[2] ..... B67D 5/58

[58] Field of Search ..... 214/17 R; 222/193, 181, 222/556; 251/212, 294; 105/250, 300–303

[56] References Cited

UNITED STATES PATENTS

| | | | |
|---|---|---|---|
| 1,009,617 | 11/1911 | Zimmerman | 105/300 X |
| 1,019,023 | 3/1912 | Christianson | 105/300 X |
| 1,465,756 | 8/1923 | Campbell | 105/250 X |
| 2,723,058 | 11/1955 | Gardes | 222/556 X |
| 3,301,441 | 1/1967 | Werner et al. | 214/17 R X |

*Primary Examiner*—Drayton E. Hoffman
*Assistant Examiner*—Norman L. Stack, Jr.
*Attorney, Agent, or Firm*—William W. Haefliger

[57] ABSTRACT

Apparatus for storing material such as wood chips, sawdust, shavings and the like comprises a. a bin, b. closure means closing the lower interior of the bin, and carrier to swing downwardly to downwardly open the bin for dumping of said material from the bin interior, and c. hoist mechanism including a flexible line element and a line spooling element, one of said elements connected with the closure means to spool the line element during swinging of said closure means.

7 Claims, 5 Drawing Figures

BIN CLOSURE SUPPORTED CLOSING MECHANISM

BACKGROUND OF THE INVENTION

This invention relates generally to bulk materials storage and dumping, and more particularly concerns improvements in bin closure mechanism.

In the past, mechanisms to open and shut the bottom closures of bins have presented problems. For example, levers and linkages used in such mechanisms are expensive to fabricate install and maintain in operating condition, particularly when openly exposed, snow and ice causing operating problems. There is a need for simpler, less expensive mechanism to operate bin closures; in particular, no way was known, to my knowledge, to provide mechanism to operate bin closures with the unusual advantage in construction, mode of operation and results as now afforded by the present invention.

SUMMARY OF THE INVENTION

It is a major object of the invention to provide very simple bin closure operating mechanism overcoming the problems referred to above as well as other difficulties. Basically, bin closure means is mounted to swing downwardly and open the bin; and hoist mechanisms is arranged to operate the closure means. As will be seen, the hoist mechanism includes a flexible line element and a line spooling element, one of such elements connected with the closure means to spool the line element during swinging of the closure means. As a result, the closure means may be closed simply by energizing the hoist mechanism, and may be opened by deenergizing the hoist mechanism; also the latter may remain protectively beneath the closure means, as during closed condition of the closure means.

Additional objects and advantages includes the use of two closures hinged to swing downwardly, by gravity, to open position, the line element connected with one swinging closure and the spooling element carried by the other swinging closure; the provision of stops on the closures to limit their closing, the line element extending adjacent such stops as will be seen; the provision of bin and cyclone structures above the hoist mechanism; and the provision of multiple side-by-side closures, each independently controlled by a hoist mechanism, as described.

These and other objects and advantages of the invention as well as the details of an illustrative embodiment, will be more fully understood from the following description and drawings, in which:

DRAWING DESCRIPTION

DETAILED DESCRIPTION

Figure 1:
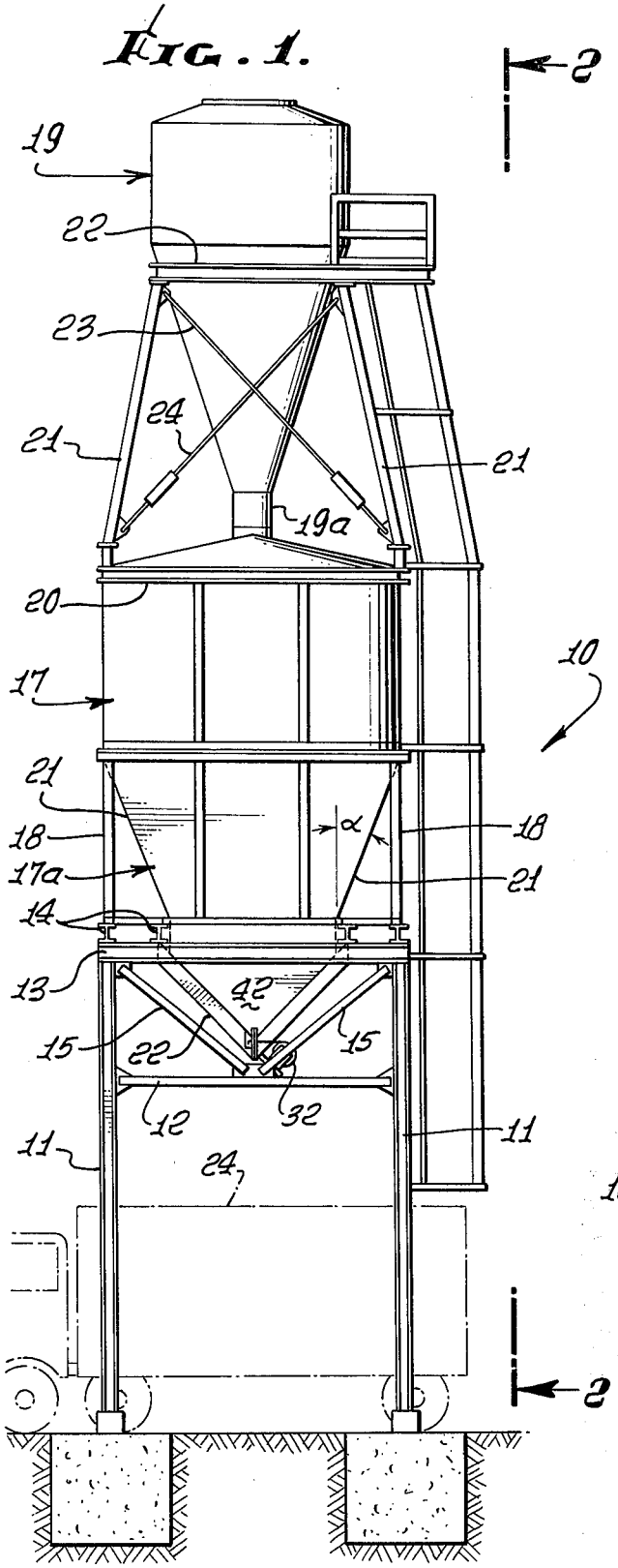
FIG. 1 is an elevation showing a bin structure with which the invention is usable.
Figure 2:
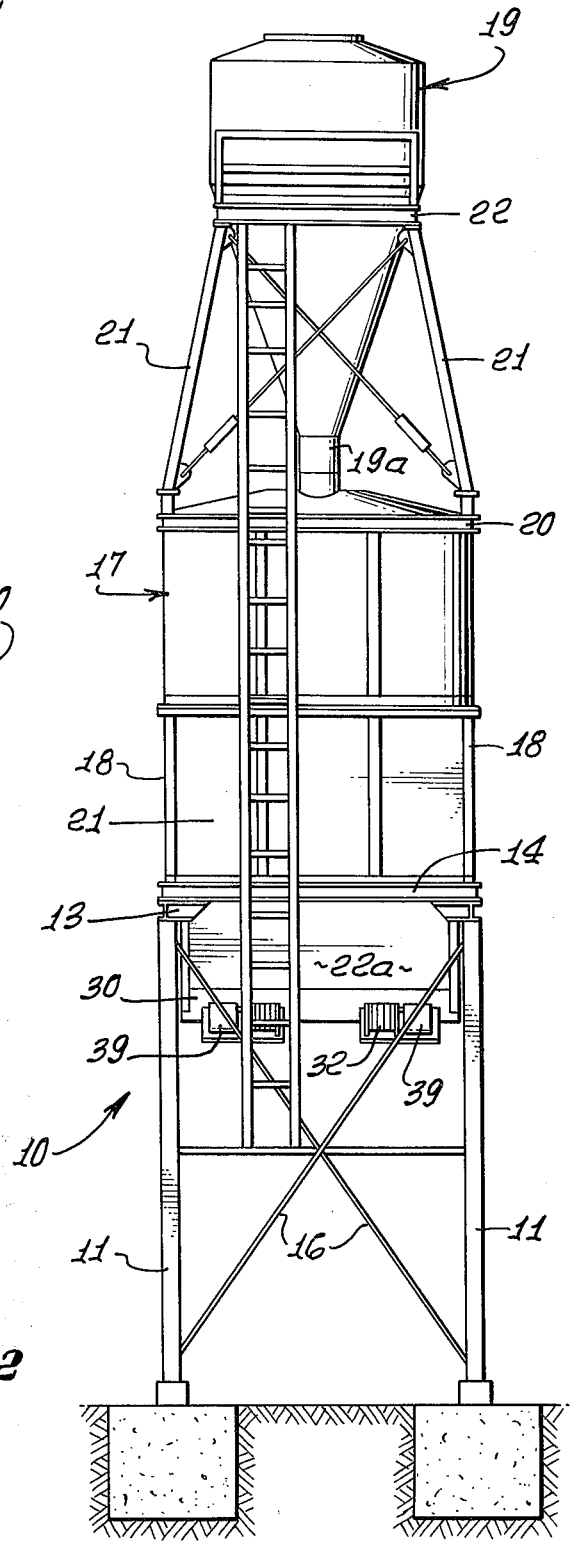
FIG. 2 is a side elevation taken on lines 2—2 of FIG. 1.

Referring first to FIGS. 1 and 2 the bin structure includes a framework 10 having uprights 11, suitable cross-members 12–14, and diagonal bracing 15 and 16. A bin 17 is supported on cross-members 14, additional upright braces 18 being employed. A cyclone 19 is supported above the bin, as via members 20–22, and diagonal bracing 23 and 24, as shown. Relatively heavy particulate material, as for example wood chips, wood shavings, sawdust or other stringy material, separates from light particles in the cyclone and drop via outlet **19*a* into the bin. Such material tends to "hang up" in the bin, unless the bin lower section 17*a* has downwardly tapered side walls 21 to direct the material toward bottom closures 22. The latter, in closed condition have a substantially greater downward and lateral taper angularity $\beta$ toward a plane 23 toward which walls 21** also taper, with lesser taper angularity $\alpha$.

Figure 3:
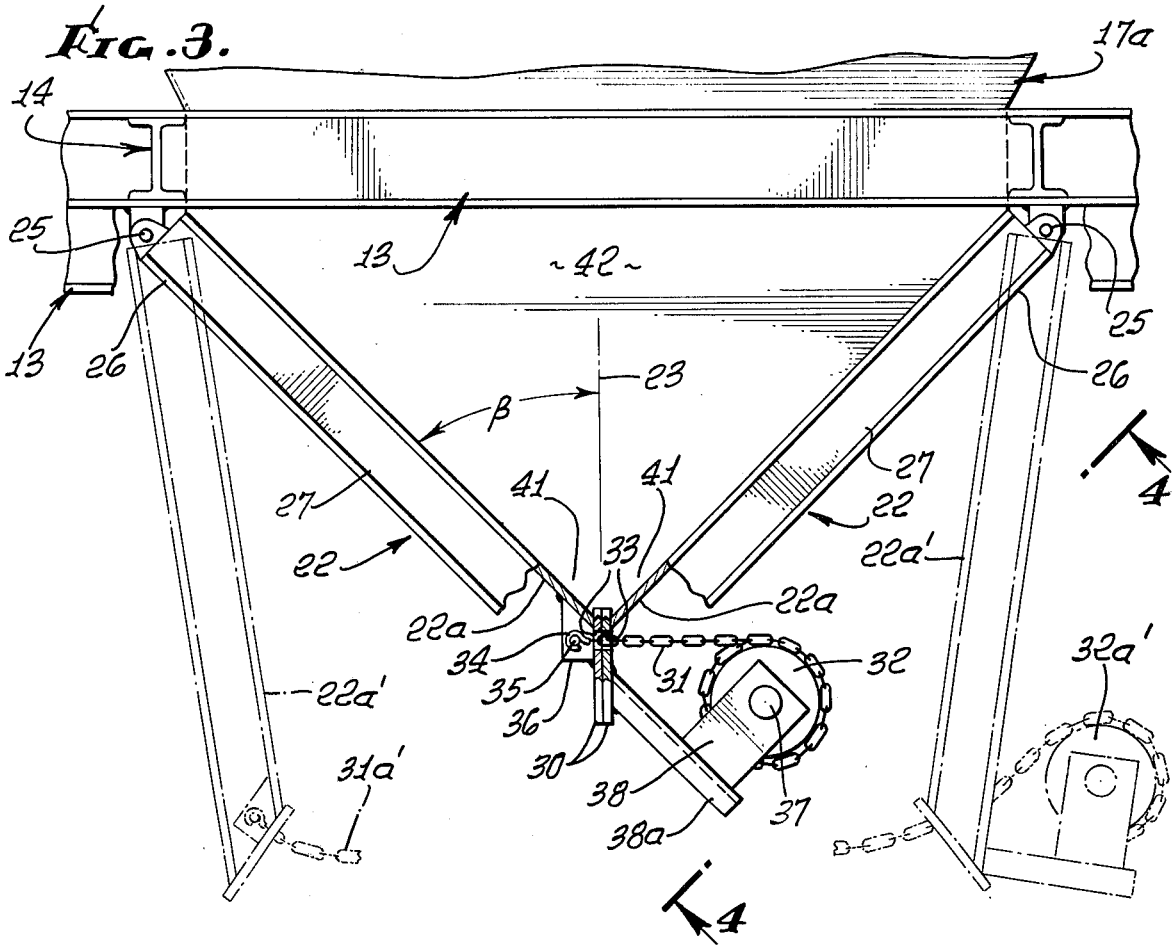
FIG. 3 is an enlarged fragmentary elevational showing of bin closure structure.
Figure 4:
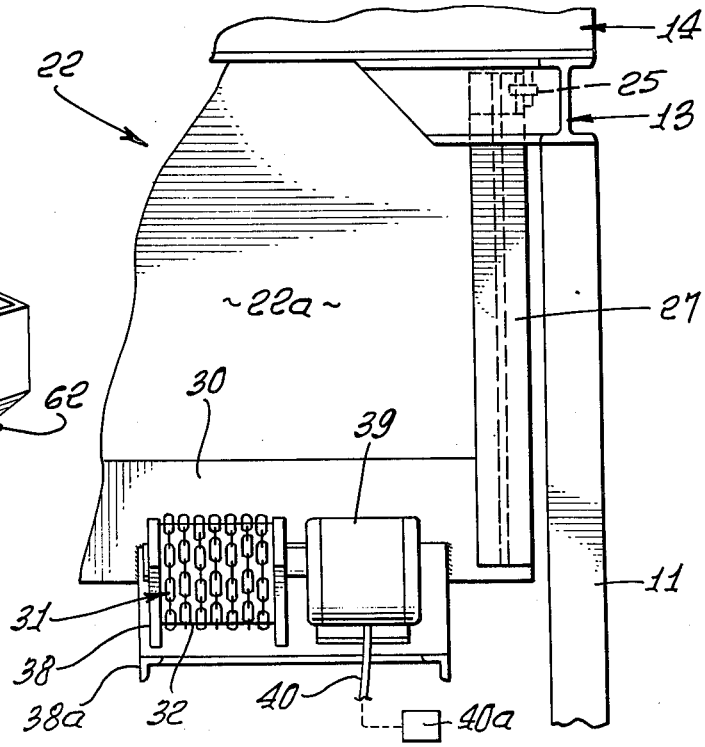
FIG. 4 is a view taken on lines 4—4 of FIG. 3.

The closures (or closure means) are carried to swing downwardly, to open the bin for dumping of the material from the bin interior, as for example into a receptacle such as the vehicle trailer indicated at 24 in FIG. 1. FIG. 3 shows hinges 25 pivotally connecting the closure upper ends 26 to the support structure 13, the hinges having parallel horizontal axes. The closures may also include reinforcing members 27 connected to the closure plates **22*a*, at their ends, as seen in FIGS. 2 and 4. In addition, the two like closures are shown to include stop plates 30 respectively attached to the lower ends of plates 22*a* and interengageable when the closures are in bin-closing position as seen in FIG. 3**.

In accordance with an important aspect of the invention, hoist mechanism is provided to include a flexible line element and a line spooling element, one of these elements connected with the closure means to spool the line element during swinging of the closure means. In the example, the two like closures are pivoted to swing relatively toward and away from each other, the line element in the form of a chain 31 being connected with one closure, and the spooling element in the form of drum 32 carried by the other closure. As shown, the chain 31 passes through suitably contoured openings 33 in the two stop plates, and one end of the chain is connected as by hook 34 to a pin 35 integral with a web 36 affixed to one closure 22 and one stop plate. The spool 32 may be carried by an axle 37 supported by bracket 38 having an arm **38*a* affixed to the other stop plate 30. An electrical drive for the spool is shown at 39 in FIG. 4, and as connected in driving relation with the axle. A control cable for the spool hangs freely at 40, and is connected with a remote control 40*a*** operated by a workman.

In operation, the drive, in FIG. 3, tensions the chain 31 to hold the bin closures in closed positions. Note the engagement of the closure plates **22*a* against the downwardly tapering lower edges 41 of the bin end walls 42. When dumping of the bin contents is desired, the spool or drum 32 is allowed to free-wheel, by the drive, so that the closures pivot downwardly to the broken line open positions as seen in FIG. 3, under the influence of gravity. The closure plates are there indicated at 22*a*'. Under such circumstances, the chain unwinds off the drum and assumes a hanging position as seen at 31*a*. Note that the spool pivots downwardly to position as seen at 32*a*, remaining at all times out of the path of the contents of the bin, which gravitate downwardly between the opened closures. The fact that the chain or line 31*a*** may hang in or across that path is of no consequence.

When bin closure is desired, the chain is tensioned in response to operation of the drive to wind the drum 32, whereby the closures are pulled together and back to FIG. 3 position.

Figure 5:
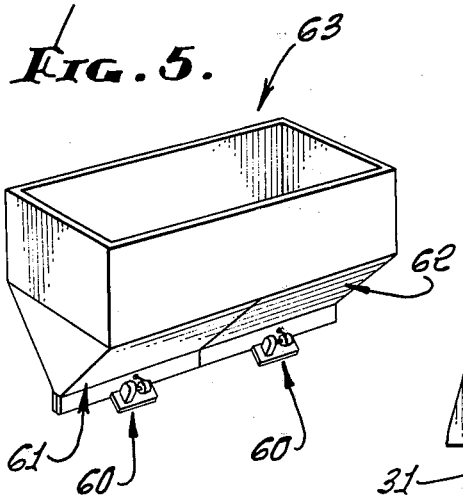
FIG. 5 is a perspective showing of a modification.

If desired, multiple side-by-side closure pairs may be supported and operated in the same manner, one example being seen in FIG. 5, where two spool and drive units are shown at 60 controlling two pairs of side-by-side closures indicated at 61 and 62. A common bin for the two pairs of closures is indicated at 63.

I claim:

1. In apparatus for storing material such as wood chips, sawdust, shavings, and the like, comprising a. a bin, b. closure means closing the lower interior of the bin, and carried to swing downwardly to downwardly open the bin for dumping of said material from the bin interior, and c. hoist mechanism including a flexible line element and a line spooling element, one of said elements connected with the closure means to spool the line element during swinging of said closure means, d. said closure means including two closures carried by the bin to swing downwardly relatively away from one another and upwardly relatively toward one another so that the lower portions of the closures swing into and out of engagement to close and open the bin, the line element connected with one swingable closure adjacent the lower end thereof and the spool element mounted on the other swingable closure to be located adjacent the lower end thereof whereby the line is unwound off the spool only a relatively short distance as the closures swing downwardly to open the bin.

2. The apparatus of claim 1 including another two closures carried by the bin to swing relatively downwardly and toward and away from one another, and a second hoist mechanism including flexible line spooling elements respectively connected with said other two closures as in claim 1.

3. The apparatus of claim 1 including stop means on the bin to limit closing of at least one of said two closures.

4. The apparatus of claim 1 including a frame supporting said bin in elevated condition, and a cyclone separator carried by the frame and having a downward outlet communicating with the bin to deliver said material thereto.

5. The apparatus of claim 4 including an auxiliary container between the separator and bin, the container having downwardly relatively tapering side walls.

6. The apparatus of claim 1 wherein the line element comprises a chain, there being an electrical drive for the spooling element, there being a bracket support for the drive also carried by said other closure.

7. The apparatus of claim 6 wherein the drive, chain and spooling element are beneath at least one closure in closed position thereof.

* * * * *